US005842760A

United States Patent [19]

Gatti et al.

[11] Patent Number: 5,842,760

[45] Date of Patent: Dec. 1, 1998

[54] STRUCTURE INSULATED FOR EXAMPLE WITH EXPANDED POLYURETHANE OR THE LIKE, SUCH AS A REFRIGERATOR CABINET, COMPRISING A PLURALITY OF COMPARTMENTS SEPARATED FROM EACH OTHER BY AN INTERSPACE, AND POSITIONED IN CORRESPONDENCE WITH SAID INTERSPACE

[75] Inventors: Giovanni Gatti, Olgiate Comasco; Fiorenzo Casoli, Vergiate; Giulio Caprioli, Gavirate; Roberto De Santi, Brenta, all of Italy

[73] Assignee: Whirlpool Corporation, Benton Harbor, Mich.

[21] Appl. No.: 957,286

[22] Filed: Oct. 24, 1997

[30] Foreign Application Priority Data

Oct. 25, 1996 [IT] Italy ..... MI96 A 002221

[51] Int. Cl.[6] ..... A47B 96/04

[52] U.S. Cl. ..... 312/406; 312/407; 220/444

[58] Field of Search ..... 312/400, 401, 312/406.1, 407; 220/430, 444, 445, 467, 464, 902

[56] References Cited

U.S. PATENT DOCUMENTS 2,837,900 6/1958 Harle ..... 312/407

FOREIGN PATENT DOCUMENTS 1501213 1/1970 European Pat. Off. .
0161724 11/1984 European Pat. Off. .
0545192 6/1993 European Pat. Off. .
2012937 8/1979 United Kingdom .

*Primary Examiner*—Peter M. Cuomo
*Assistant Examiner*—Gerald A. Anderson
*Attorney, Agent, or Firm*—Stephen D. Krefman; Thomas J. Roth; Robert O. Rice

[57] ABSTRACT

A structure insulated for example by expanded polyurethane or the like, such as a refrigerator cabinet or freezer cabinet, comprises a plurality of compartments separated from each other by an interspace, the insulating material injected into said structure enclosing said compartments on all sides except the access side and positioning itself in the interspace. At opposing ends of said interspace there are positioned separator means openable in the manner of an envelope and arranged to separate, during its injection into the structure, the insulating material directed around the compartments from that directed into the interspace, said separator means comprising a flat portion parallel to the sides of the insulated structure.

7 Claims, 2 Drawing Sheets

STRUCTURE INSULATED FOR EXAMPLE WITH EXPANDED POLYURETHANE OR THE LIKE, SUCH AS A REFRIGERATOR CABINET, COMPRISING A PLURALITY OF COMPARTMENTS SEPARATED FROM EACH OTHER BY AN INTERSPACE, AND POSITIONED IN CORRESPONDENCE WITH SAID INTERSPACE

BACKGROUND OF THE INVENTION

1. Field of the Invention

This invention relates to a structure insulated for example by expanded polyurethane or the like, such as a refrigerator or freezer cabinet comprising at least two compartments in accordance with the introduction to the main claim. In an insulated structure of the aforesaid type, it is known that disuniformity can occur in the thickness of the insulating material injected into it and surrounding said compartments. In particular, such disuniformity can occur in the interspace present between these compartments. Consequently, in the greater thickness regions said material, after injection, cools in a longer time than the cooling time of the material present in the lesser thickness regions. In the lesser thickness regions, this material is subject to greater shrinkage than in the other regions, leading to visible deformation of the cabinet at these lesser thickness regions. This occurs in particular in those wall regions close to the interspace present between said compartments.

This deformation of the side and/or rear walls detracts from the appearance of the insulated structure, which can cause obvious problems in particular if this structure is a refrigerator cabinet.

More precisely, in injecting the refrigerator structure or cabinet with the expanded polyurethane, when the expanded polyurethane reaches the interspace between the compartments it becomes arranged anisotropically with respect to the side walls. With the polymerization of the insulating polyurethane material, there is considerable shrinkage of the cabinet sides at the interspace, the surfaces of the sides being "sucked" towards the interior of the cabinet.

2. Description of the Related Art

EP0545192 describes an insulated structure (refrigerator cabinet) comprising two compartments between which there is injected an insulating material. At at least one end of this interspace between the compartments there are positioned separator means comprising a flat part arranged parallel to the sides of said refrigerator structure or cabinet from which there perpendicularly extends a portion resting on a corresponding face of one of said compartments. This portion terminates with a flat part in contact with said face. Although this solution enables deformation of the corresponding cabinet side to be avoided, it is of relatively complicated implementation and assembly, and is therefore of high cost.

EP0161724 describes another solution for preventing local deformation of the sides of a refrigerator cabinet following injection of insulating material into the interspace between two internal compartments of said insulated structure. The solution consists of arranging at least on one side of this interspace (facing the cabinet sides) an adhesive tape provided with apertures allowing the insulating material to pass into the interspace during its injection into said structure. Although this solution limits the deformation of the refrigerator cabinet sides, it does not allow optimum injection of the insulating material into the interspace present between the compartments because of the limited apertures provided in the adhesive tape. Consequently, the insulation of these compartments is imperfect, with obvious drawbacks.

GB 118581 describes a method for creating an insulated structure comprising an inner compartment, such as a refrigeration compartment. This prior patent states that the injection of the insulating material into the structure interspaces gives rise to stressing towards the exterior of the interspaces caused by the expansion of the insulating material. The walls of said structure are hence subjected to forces which can split them. To prevent these damaging effects on said walls, this prior patent provides for the insertion into said interspaces of flexible members which support the forces generated by the expansion of the insulating material. These members are spaced apart and can be hollow. In this manner, because of their yieldability, a space is created within the interspace such as to limit the stress of the insulating material (which fills this space) against the walls of the insulated structure.

This prior patent therefore deals with a problem different from that previously stated relative to the polymerization and solidification of the insulating materials and in particular does not describe any deformation of the walls of the insulated structure towards its interior caused by said hardening (polymerization and cooling).

SUMMARY OF THE INVENTION

An object of the present invention is to provide an insulated structure, for example a refrigerator cabinet, of the stated type in which during solidification and cooling of the insulating material after its injection there is no consequent "sucking-in" of each cabinet side wall.

A further object of the invention is to provide an insulated structure in which the absence of this surface deformation after introducing the insulating material into it is achieved without high cost and with a short implementation time.

These and further objects which will be apparent to the expert of the art are attained by an insulated structure of the aforesaid type in accordance with the accompanying claims.

BRIEF DESCRIPTION OF THE DRAWINGS

The present invention will be more apparent from the accompanying drawing, which is provided by way of non-limiting example and in which.

DESCRIPTION OF THE PREFERRED EMBODIMENT

Figure 1:
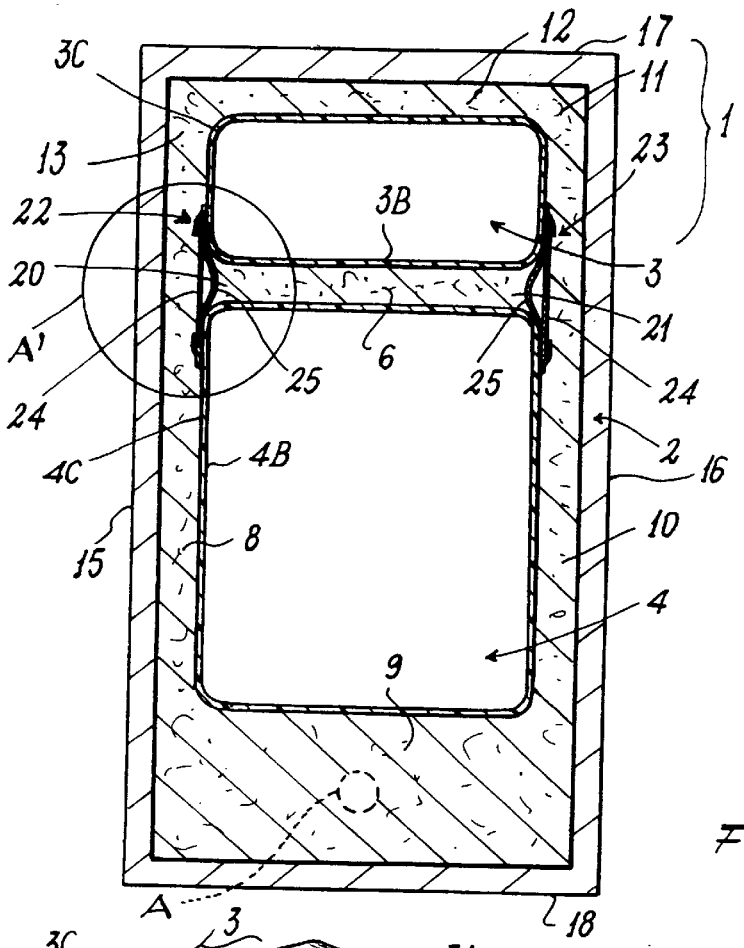
FIG. 1 is a cross-section through a refrigerator cabinet formed in accordance with the invention.
Figure 2:
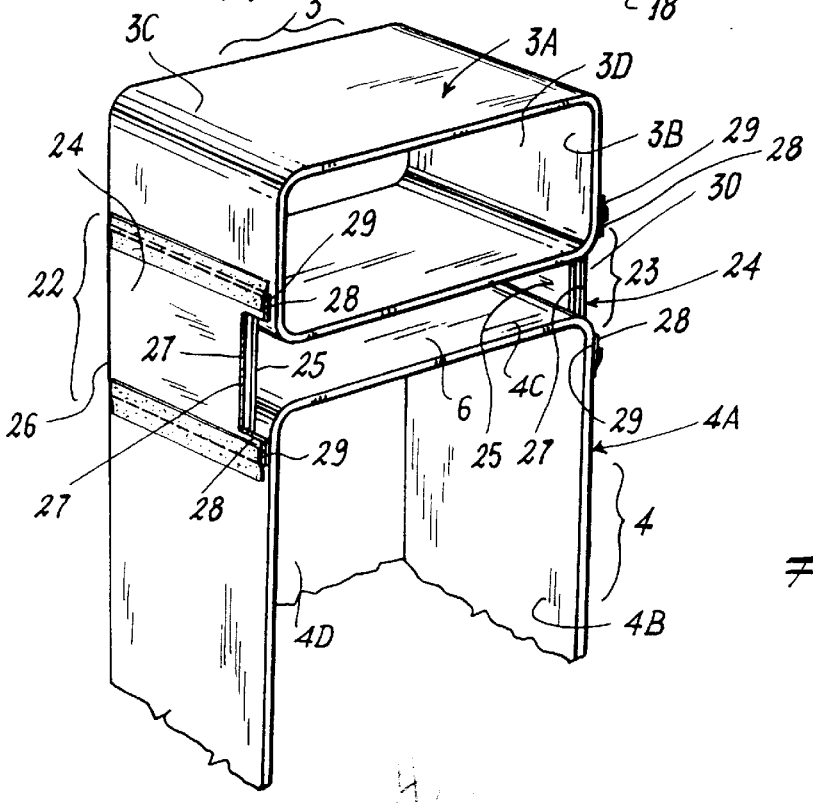
FIG. 2 is a perspective view of the cabinet of FIG. 1 with some parts omitted for greater clarity.

With reference to said figures, a refrigerator cabinet is indicated overall by 1 and comprises an outer housing 2 enclosing two overlying compartments 3 and 4 intended to define a freezer compartment and a refrigerating compartment respectively.

The two compartments 3 and 4 are separated by an interspace 6. Lateral interspaces from 8 to 13 separate the compartments 3 and 4 from the housing 2.

Each compartment 3 and 4 comprises a substantially parallelepiped hollow body 3A and 4A having inner walls 3B and 4B and outer walls 3C and 4C and an access side 3D and 4D for introducing into said compartments the food to be preserved.

The interspaces 6, 8, 9, 10, 11, 12 and 13 contain a usual insulating material, for example expanded polyurethane acting as insulant.

The housing 2 comprises side walls 15 and 16, an upper wall 17 and a lower wall 18. Interspace 6 has opposing lateral ends 20 and 21.

Figure 3:
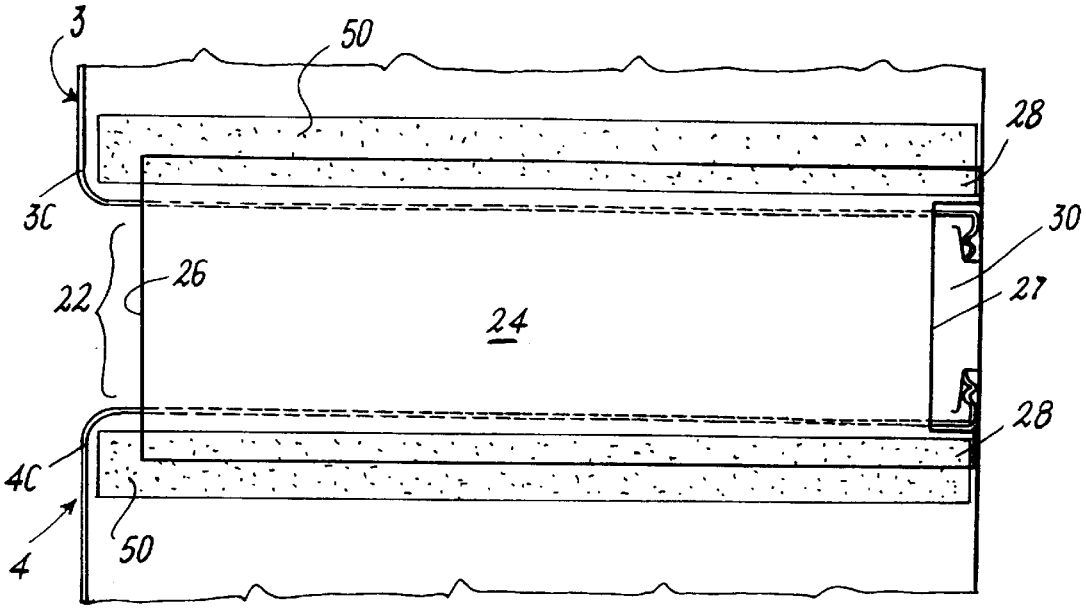
FIG. 3 is a side view of part of the cabinet of FIG. 1.

In correspondence with those lateral ends 20 and 21 of the interspace 6 facing said side walls 15 and 16 there are provided separator members 22 and 23 separating said interspace from the lateral interspaces. These members are fixed to the walls 3C and 4C of the compartments 3 and 4 by adhesive tape 50. During this fixing, said members are preferably positioned as far as possible on the center line of the interspace (FIG. 3) to prevent their presence obstructing correct flow of insulating material into the interspace 6.

The separator elements or members 22, 23 are of semi-rigid type (for example of papery material such as cardboard, or plastic), in relation to their surface dimensions and thickness, and each comprises at least two mutually facing flat portions 24 and 25 and connected together at one end 26 and connected partially together at the opposite end 27. Specifically, in correspondence with end 26 and 27, these two portions comprise parallel end projections 28 and 29 connected together at their ends and defining a recess 30. In one embodiment, at this recess the portions 24 and 25 are free of each other so that the end 27 of each member 22 or 23 is open. In this manner, each of these members assumes an "envelope" form, openable at one end (the end 27). Alternatively, the members 22 and 23 can simply be superposed sheets joined together in any manner (for example at one end, mechanically, adhesively or without any discontinuity of shape). If these sheets form a peripherally closed envelope of air-impermeable material, the presence of trapped air can be accepted. If however they are only partially joined together, there must be no air between them. On injecting the polyurethane into the housing 2, which is done in known manner, each member 22 and 23 maintains the filling streams of this insulating material occupying the lateral interspaces 8, 10, 11, 12 and 13 and the interspace 6 separated from each other. In this respect, the filling of interspace 6 occurs at least simultaneously with the filling of the cavities 11, 12 and 13 (assuming the polyurethane to be injected into the region A of the cabinet 1 shown in FIG. 1). In addition, because of the recess 30 in these members, a correct flow of insulating material within and about the interspace 6 is ensured, together with complete and correct insulation of the upper part of the refrigerator cabinet. Following this filling, the cavities 8, 9 and 10 become filled.

Figure 4:
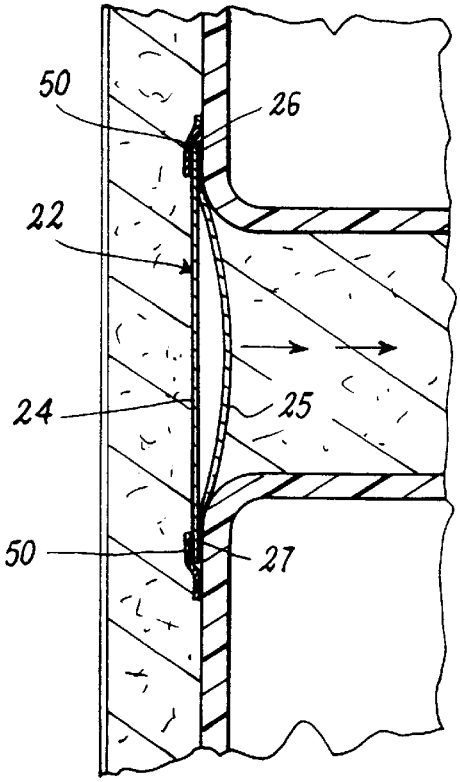
FIG. 4 is an enlarged view of the part indicated by A in FIG. 1.

This deformability of each member 22 and 23 results in virtual annulnent of the sucking effect which, in cabinets of the state of the art, the polyurethane exerts on the sides of the outer housing thereof when the insulating material shrinks on cooling. In particular, the shrinkage of the polyurethane towards the interior of the interspace 6 causes detachment of the portion 25 from the portion 24 of each separator member, which therefore opens in the manner show in FIGS. 1 and 4. In this manner, the wall 24 of each member remains parallel to the corresponding side 15 or 16 of the housing 2, each sucking action of the polyurethane on this side being exerted on the portion 25. In this manner, said sides are not deformed by the action of the polyurethane and remain perfectly flat.

One embodiment of the invention has been described. Modifications can, however, be made thereto (for example, a plurality of separator members can be provided in correspondence with the ends 20 and 21 of the interspace 6), which are, however, to be considered as falling within the scope of the present document.

We claim:

1. A structure insulated for example by expanded polyurethane such as a refrigerator cabinet or freezer cabinet, comprising at least two compartments having inner walls and outer walls separated from each other by an interspace having opposing ends, the insulating material injected into said structure in any known manner surrounding said compartments on all sides except an access side, the interspace having at least one separator member at one of said opposing ends of said interspace there being provided at least one separator member arranged to separate, during its injection into the structure, the insulating material directed around the compartments from that directed into the interspace, wherein said separator member comprises at least two portions, said portion connected together having first and second ends, at at least one of said ends, said portions being able to withdraw from each other following the injection of the insulating material into the interspace.

2. An insulated structure as claimed in claim 1, wherein the separator member comprises end projections defining a recess allowing the entry of the insulating material into the interspace present between the compartments.

3. An insulated structure as claimed in claim 1, wherein the separator member is formed of semi-rigid papery material, preferably cardboard.

4. An insulated structure as claimed in claim 1, wherein the separator member is formed of semi-rigid plastic material.

5. An insulated structure as claimed in claim 1, wherein the separator member is an envelope configuration, closed on the four sides.

6. An insulated structure as claimed in claim 1, wherein the separator member is fixed to the compartments by adhesive tape.

7. An insulated structure, in particular a refrigerator cabinet having at least one freezer compartment and a refrigeration compartment separated by an interspace having an interior and opposed lateral ends, said interspace containing insulating material such as expanded polyurethane, said structure surrounding said compartments but leaving an access side thereof free for the introduction into the compartments of food to be preserved, said structure comprising, in correspondence with each lateral end of said interspace there is provided an envelope-shaped element having a first flat part associated with a second flat part via at least one end, said second part being withdrawn from the first towards the interior of the interspace, the first part being substantially parallel to a corresponding side of the insulated structure.

* * * * *